US008360120B2

(12) United States Patent
Chuang

(10) Patent No.: US 8,360,120 B2
(45) Date of Patent: Jan. 29, 2013

(54) TWO-SIDED PLANER

(76) Inventor: Bor-Yann Chuang, Taiping (TW)

( * ) Notice: Subject to any disclaimer, the term of this patent is extended or adjusted under 35 U.S.C. 154(b) by 234 days.

(21) Appl. No.: 12/859,119

(22) Filed: Aug. 18, 2010

(65) Prior Publication Data

US 2012/0042989 A1 Feb. 23, 2012

(51) Int. Cl.
*B27C 1/00* (2006.01)

(52) U.S. Cl. ..... 144/114.1; 144/116; 144/117.4; 144/129; 144/130

(58) Field of Classification Search ..... 144/114.1, 144/117.1, 116, 117.4, 129, 128, 130, 253.5, 144/253.8
See application file for complete search history.

(56) References Cited

U.S. PATENT DOCUMENTS 2,552,367 A * 5/1951 Carlson ..... 144/128
2,619,997 A * 12/1952 Gaskell ..... 144/129
2,624,382 A * 1/1953 Moore ..... 144/116
2,780,251 A * 2/1957 Williams ..... 144/130
3,067,788 A * 12/1962 Eschenburg ..... 144/117.1
4,456,042 A * 6/1984 Clark et al. ..... 144/129
4,997,017 A * 3/1991 Dobbie ..... 144/128
7,252,124 B1 * 8/2007 Chuang ..... 144/117.1
7,458,402 B2 * 12/2008 Wixey et al. ..... 144/117.1

* cited by examiner

*Primary Examiner* — Bena Miller
(74) *Attorney, Agent, or Firm* — Ming Chow; Sinorica, LLC

(57) ABSTRACT

A two-sided planer comprises a base, an adjusting base, and a floated pressing unit. Wherein, the floated pressing unit includes an axle shaft superimposed by several pressing rings. A spacing is defined between an inner surface of the pressing ring and the axle shaft. Plural elastic propping element are disposed within the spacing. Thereby, in the planing operation, the pressing rings adjust their positions upward or downward in accordance with a configuration of a workpiece. Whereby, the workpiece is restricted rather than warped. As a result, the workpiece does not resume warped after being planed smooth, which allows the two-sided planer to achieve a preferable planing operation.

7 Claims, 9 Drawing Sheets

TWO-SIDED PLANER

BACKGROUND OF THE INVENTION

1. Field of the Invention

The present invention relates to two-sided planer.

2. Description of the Related Art

Generally, a planer usually comprises a base having a working platen. An adjusting pedestal is arranged above the working platen via several adjusting shafts. A plane is disposed on the working platen, and a plurality of pressing shafts as well as a progressing shaft are installed on the adjusting pedestal. Thereby, while a workpiece such as a plank is disposed on the working platen, the workpiece is moved by the progressing shaft toward the plane. Concurrently, the pressing shafts press and fix the workpiece for preventing the workpiece from an adverse movement. Consequently, the plane executes the planing on the workpiece for removing the uneven surface of the workpiece. However, before the workpiece is planed even, the workpiece is usually warped. Herein, since the pressing shafts are integrally formed, and a certain internal stress exists in the planed workpiece that was originally warped, the workpiece unfavorably recovers the warped state after the planing operation. As a result, the planing task cannot be effectively achieved. In addition, the adjusting pedestal is in fact limited on the adjusting shafts, so an adjustment in the adjusting pedestal of the conventional planer is usually achieved by amending one to two of the adjusting shafts for the whole adjusting pedestal to be moved upward or downward along the adjusting shafts. Nonetheless, such adjustment readily results in a slanted adjusting pedestal, and thereby an inferior processing surface on the workpiece is incurred. Therefore, the conventional planer needs an amendment.

SUMMARY OF THE INVENTION

It is an object of the present invention to provide a two-sided planer comprising a base, an adjusting base, and a floated pressing unit. Wherein, the base includes a working platen. A plurality of adjusting shafts are disposed adjacent to the working platen. A lower plane is pivoted on the base corresponding to the working platen. The lower plane is served as a reference line for the working platen to be longitudinally divided into a front working area and a rear working area. The adjusting base has adjusting holes disposed corresponding to the adjusting shafts for being penetrated by the adjusting shaft, so that the adjusting base is mounted above the working platen. An accommodating room is depressed on one side of the adjusting base facing the working platen. A pre-pressing plate, at least one pressing shaft, an upper plane, and a progressing shaft are sequentially pivoted within the accommodating room along a longitudinal direction of the working platen. The pre-pressing plate is arranged at the front working area. Whereas, the pressing shaft, the upper plane, and the progressing shaft are arranged at the rear working area. The floated pressing unit is pivoted within the accommodating room of the adjusting base. The floated pressing unit is further situated between the pre-pressing plate and the pressing shaft as well as arranged at the front working area. The floated pressing unit includes an axle shaft, plural pressing rings and plural elastic propping elements. Wherein, the axle shaft pivoted to the adjusting base radially defines a plurality of cross-sections, each of which has a plurality of receiving recesses disposed around an outer surface of the axle shaft. The pressing rings are respectively superimposed on the axle shaft with respect to the cross-sections. A spacing is defined between an inner surface of the pressing ring and the axle shaft. The elastic propping elements are received in the receiving recesses. One end of the elastic propping element protrudes from the receiving recess to elastically prop against the inner surface of the pressing ring. Thereby, in the planing operation, the pressing ring upward and downward adjusts its position in accordance with the configuration of the workpiece, so that the workpiece will be properly restricted without deforming. Thus, such planed workpiece will not resume warped, and the two-sided planer achieves the preferable planing operation.

DETAILED DESCRIPTION OF THE PREFERRED EMBODIMENTS

Figure 1:
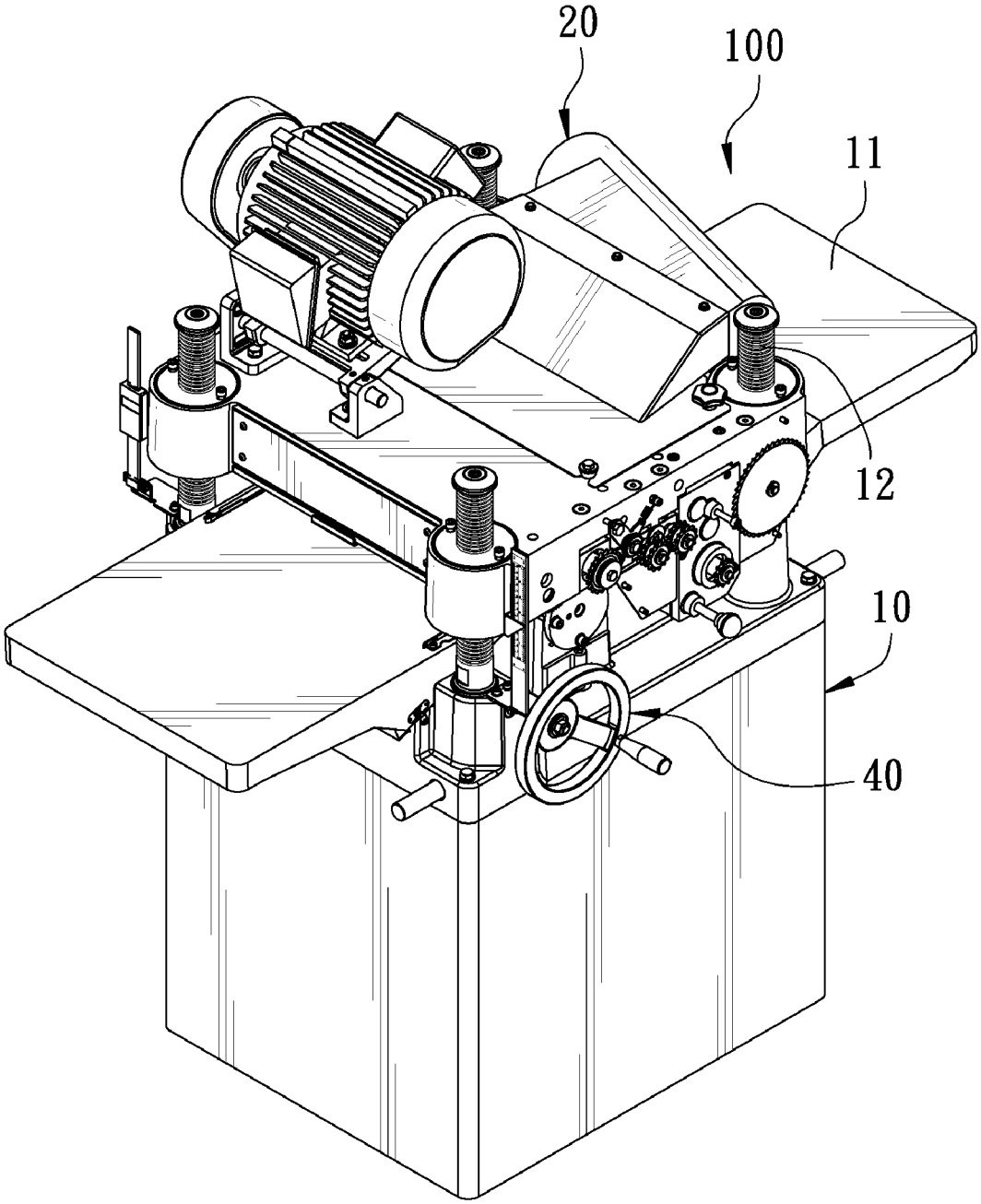
FIG. 1 is a perspective view of the present invention.
Figure 2:
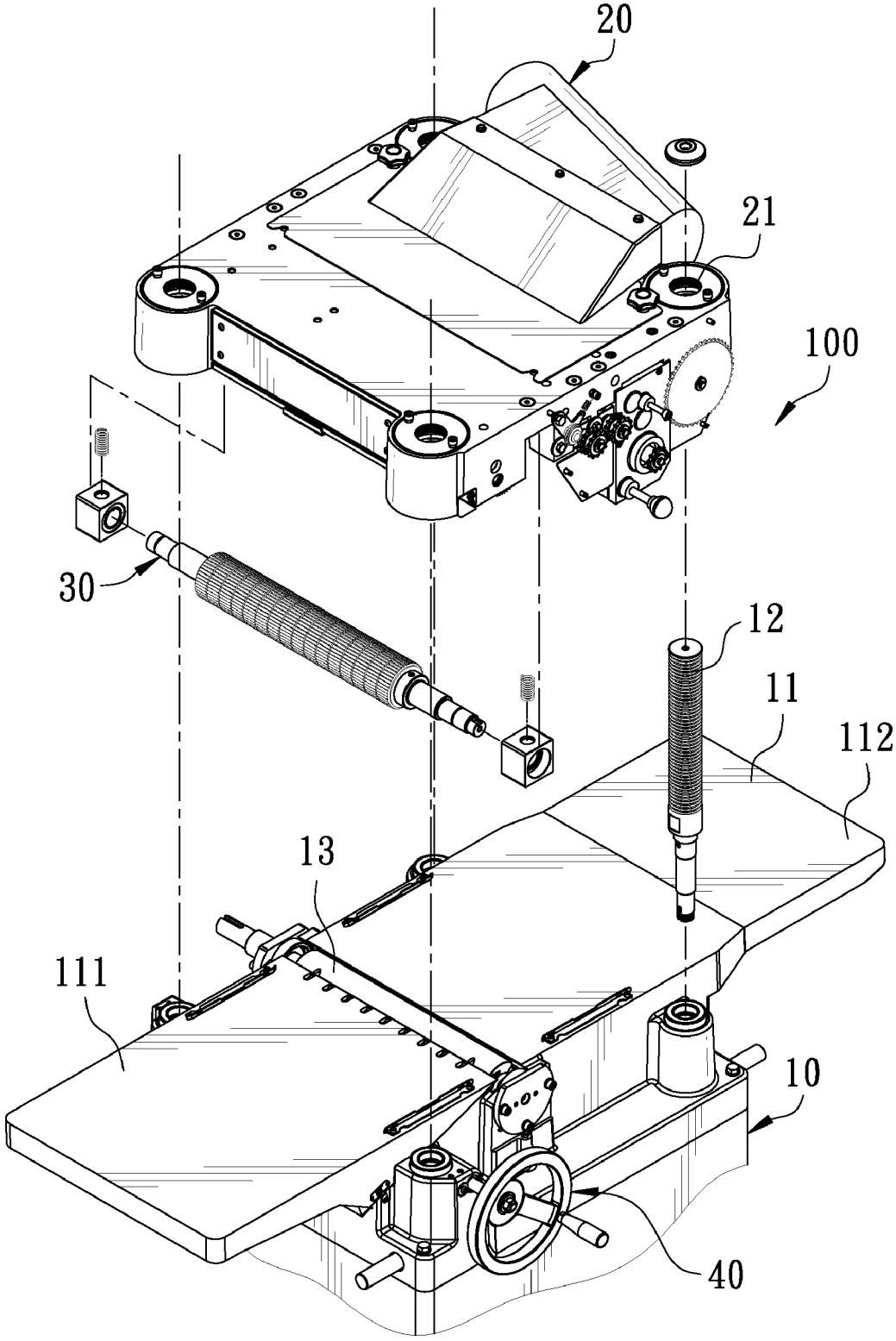
FIG. 2 is a partial enlarged view of the present invention.
Figure 3:
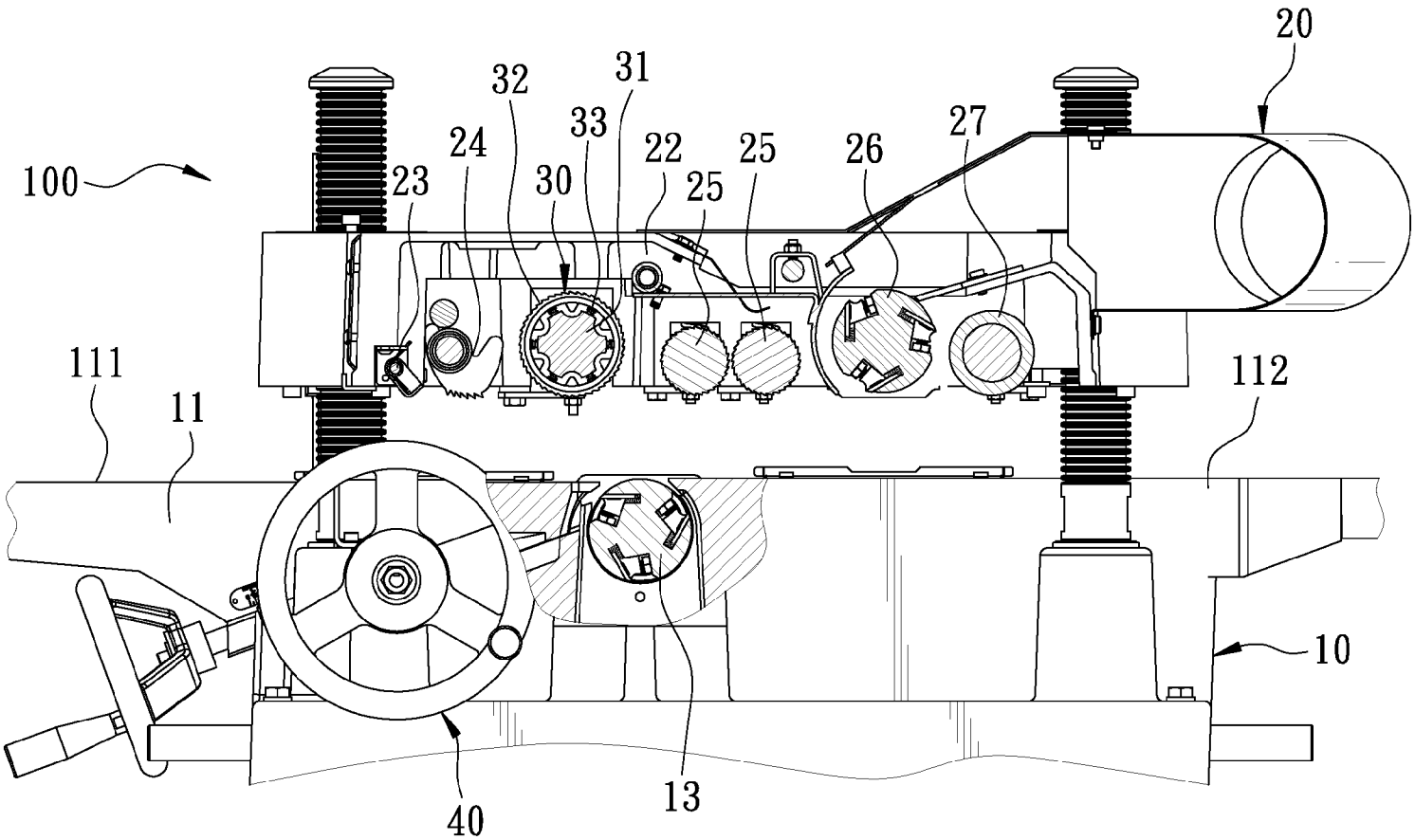
FIG. 3 is a partial cross-sectional view of the present invention.

FIGS. 1, 2, and 3 show a perspective view, a partial enlarged view, and a partial cross-sectional view of the present invention. A two-sided planer 100 substantially comprises:

A base 10 includes a working platen 11. A plurality of adjusting shafts 12 are disposed adjacent to the working platen 11. The base 10 further has a lower plane 13 pivoted on the working platen 11. The lower plane 13 is served as a reference line for the working platen 11 to be longitudinally divided into a front working area 111 and a rear working area 112.

An adjusting base 20 has adjusting holes 21 disposed corresponding to the adjusting shafts 12 for being penetrated by the adjusting shaft 12. The adjusting base 20 is mounted above the working platen 11. An accommodating room 22 is concavely disposed on one side of the adjusting base 20 facing the working platen 11. A pre-pressing plate 23, an anti-receding gear 24, two pressing shafts 25, an upper plane 26, and a progressing shaft 27 are sequentially pivoted within the accommodating room 22 along a longitudinal direction of the working platen 11. Wherein, the pre-pressing plate 23 and the anti-receding gear 24 are arranged at the front working area 11. Whereas, the pressing shaft 25, the upper plane 26, and the progressing shaft 27 are arranged at the rear working area 112.

Figure 4:
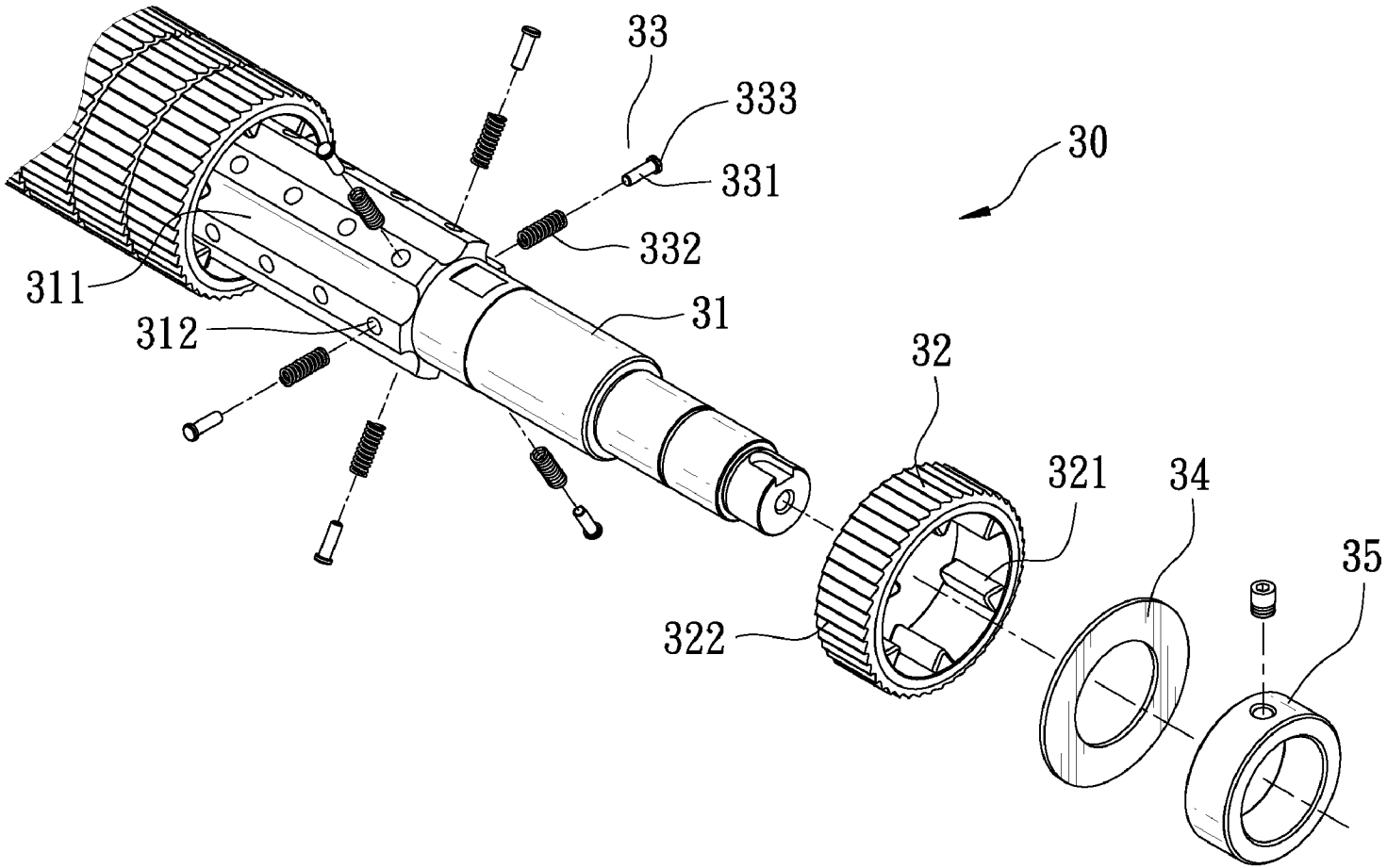
FIG. 4 is a partial enlarged view of the floated pressing unit of the present invention.
Figure 5:
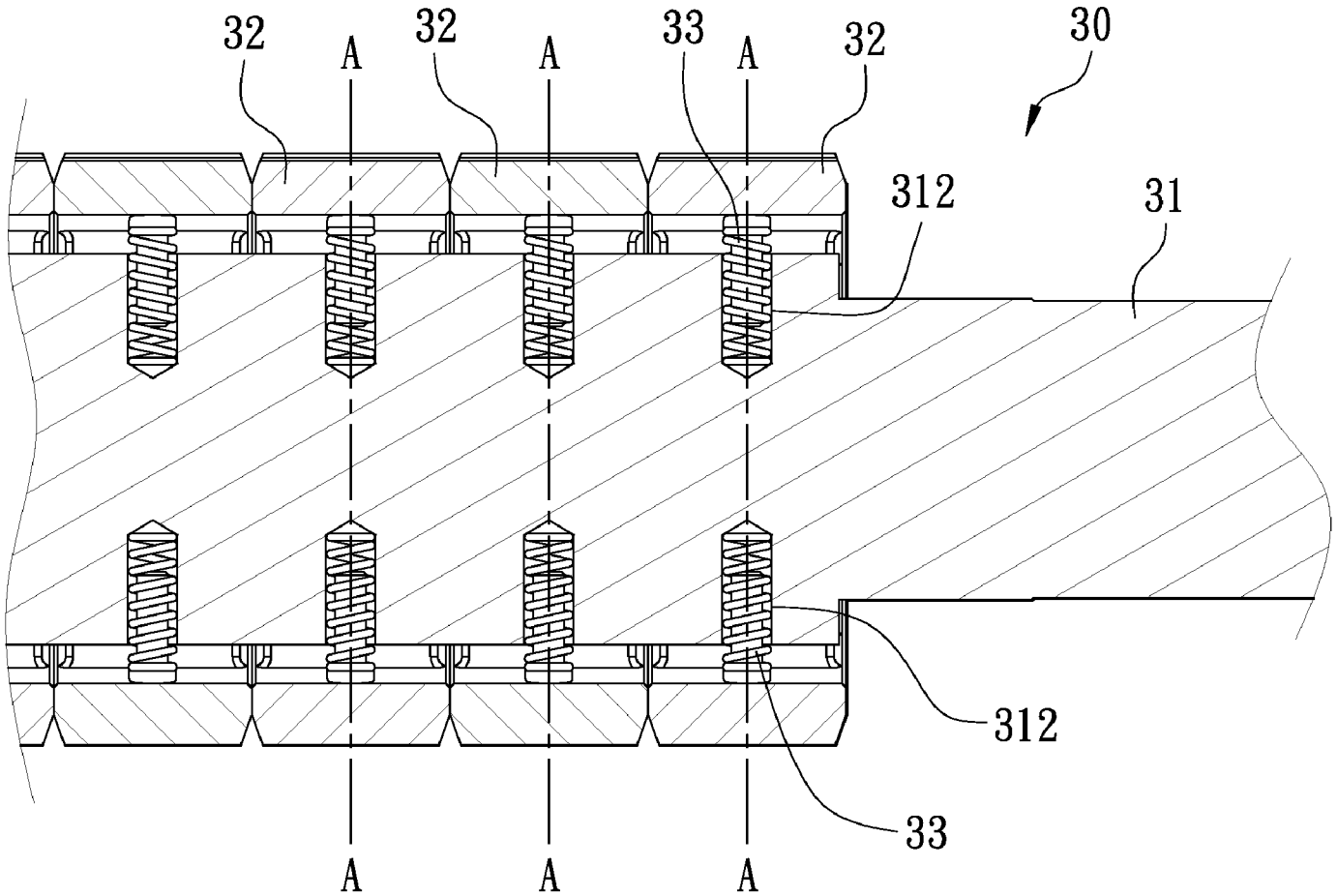
FIG. 5 is an axial cross-sectional view showing the floated pressing unit of the present invention.
Figure 6:
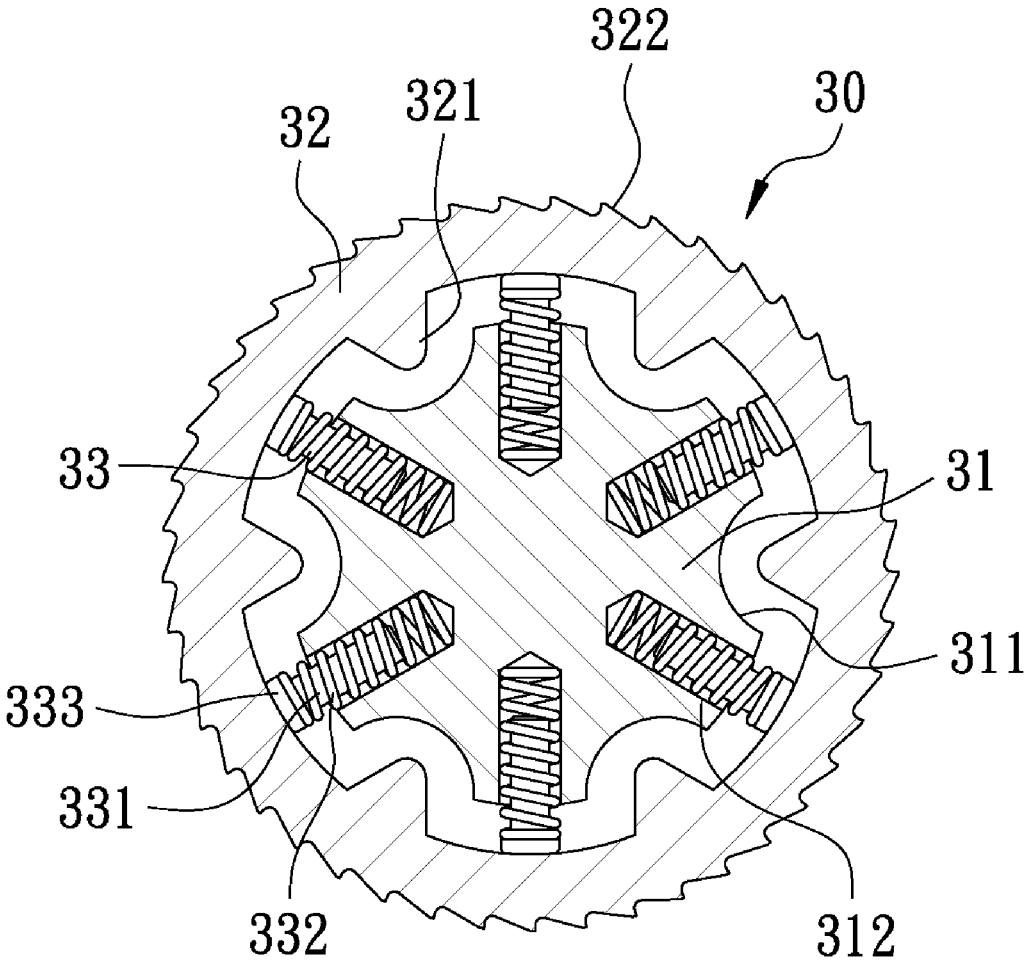
FIG. 6 is a longitudinal cross-sectional view showing the floated pressing unit of the present invention.

A floated pressing unit 30 is pivoted within the accommodating room 22 of the adjusting base 20. The floated pressing unit 30 is further situated between the pre-pressing plate 23 and the pressing shaft 25 as well as arranged at the front working area 111. As shown in FIGS. 4, 5 and 6, the floated pressing unit 30 includes an axle shaft 31, plural pressing rings 32, plural elastic propping elements 33, two limiting plates 34, and two limiting rings 35.

Wherein, the axle shaft 31 pivoted to the adjusting base 20 has a plurality of longitudinal recesses 311 axially disposed on the outer surface thereof at equivalent intervals. Accompanying with FIG. 5, the axle shaft 31 pivoted radially defines a plurality of cross-sections A, each of which has a plurality of receiving recesses 312 disposed around the outer surface of the axle shaft 31. Moreover, the receiving recesses 312 are respectively disposed between each two longitudinal recesses 311.

The pressing rings 32 are respectively superimposed on the axle shaft 31 with respect to the receiving recesses 312. A spacing is defined between an inner surface of the pressing ring 32 and the axle shaft 31. A prominent element 321 is arranged on the inner surface of the pressing ring 32 corresponding to the longitudinal recess 311. In addition, a circle of one-way gear 322 is surrounded on the outer surface of the pressing ring 32.

The elastic propping elements 33 are received in the receiving recesses 312. One end of the elastic propping element 33 protrudes from the receiving recess 312 to elastically prop against the inner surface of the pressing ring 32. In this embodiment, the elastic propping element 33 includes a rod 331 and a spring 332. One end of the rod 331 protrudes out of the receiving recess 312 for forming a head portion 333. The spring 332 places around the rod 331 and stays between the head portion 333 and the receiving recess 312 for elastically pushing the head portion 333, so that the head portion 333 props against the inner surface of the pressing ring 32.

The limiting plates 34 are respectively positioned at two ends of the axle shaft 31, corresponding to an exterior of the pressing rings 32. The limiting rings 35 are respectively positioned at two ends of the axle shaft 31, corresponding to an exterior of the limiting plates 34. Thereby, the pressing rings 32 are limited to the axle shaft 31 for preventing the pressing rings 32 from being slipped out of the axle shaft 31.

Figure 7:
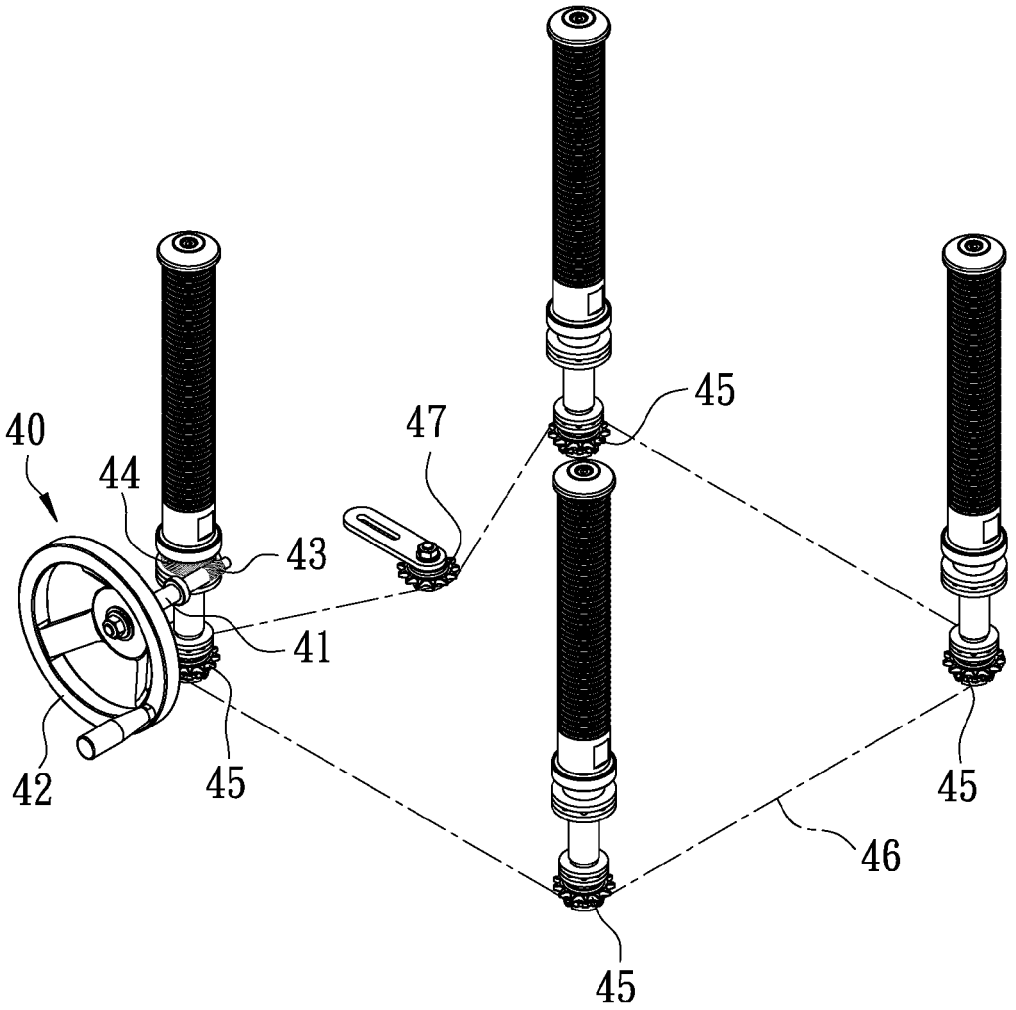
FIG. 7 is a schematic view showing the adjusting unit of the present invention in connection.

Besides, referring to FIG. 7, in this embodiment, the two-sided planer 100 further comprises an adjusting unit 40 including a driving shaft 41 pivoted to the base 10. The driving shaft 41 is situated adjacent to one of the adjusting shafts 12. Concurrently, one end of the driving shaft 41 protrudes out of the base 10 for connecting to a hand wheel 42. The other end of the driving shaft 41 connects to a worm 43. A correspondent worm wheel 44 is disposed on the adjusting shaft 12 that is close to the driving shaft 41, so that the driving shaft 41 permits driving a rotative operation of the adjusting shaft 12. The adjusting unit 40 further comprises a plurality of gear units 45 respectively disposed on a bottom of each adjusting shaft 12. The adjusting unit 40 is arranged on the gear units 45 via a chain 46 disposed therearound, so that users are able to drive the adjusting shafts 12 via the hand wheel 42. The adjusting unit 40 further comprises an adjusting gear 47 disposed on the base 10, and the adjusting gear 47 is engaged with the chain 46 for tensioning the chain 46.

Figure 8:
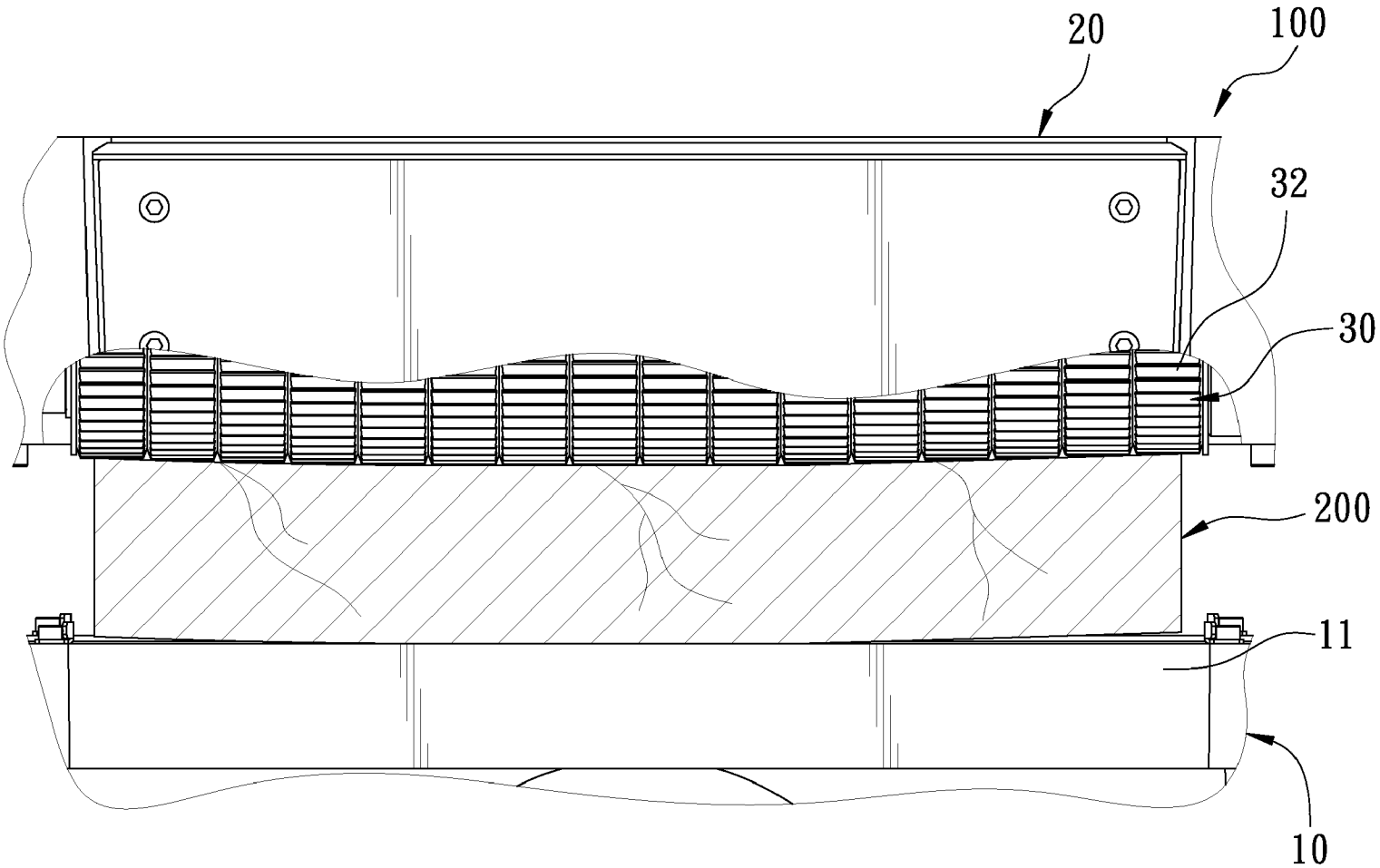
FIG. 8 is a schematic view of the present invention in using.
Figure 9:
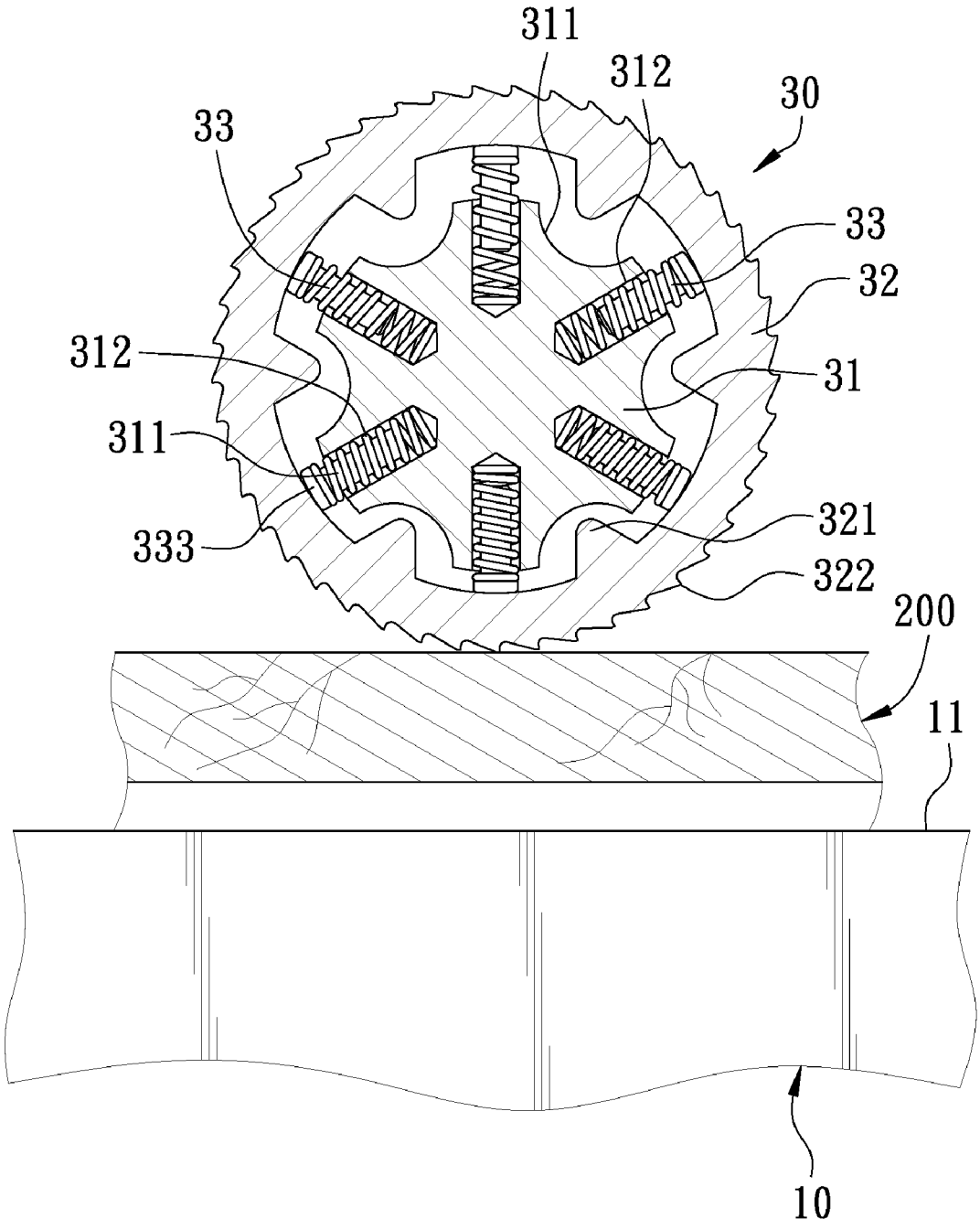
FIG. 9 is a schematic view of the floated pressing unit of the present invention in operating.

Referring to FIGS. 8 and 9, schematic views of the present invention in using and the floated pressing unit in operating are shown. Accompanying with FIG. 3, a workpiece 200 with two warped ends is to be planed by the two-sided planer 100. First, the progressing shaft 27 conveys the workpiece 200 from the front working area 111 to the rear working area 112. Herein, the pre-pressing plate 23 initially fixes the workpiece 200 for preventing the workpiece 200 from an adverse vibration. The anti-receding gear 24 further obstructs the workpiece 200 from bouncing toward the front working area 111 while planing. Favorably, since the elastic propping element 33 is disposed between the pressing ring 32 and the axle shaft 31 of the floated pressing unit 30, the pressing rings 32 preferably adjust their upward and downward positions in accordance with the configuration of the workpiece 200 while the workpiece 200 is conveyed to the floated pressing unit 30, which causes the workpiece 200 to be efficiently subdued without deforming. As a result, the workpiece 200 could be preferably restricted but not warped after being planed. Thereby, the lower plane 13 genuinely planes the bottom of the workpiece 200 smooth. Due to the quite flat bottom of the workpiece 200, the workpiece 200 would not be readily warped even when the pressing shafts 25 press the workpiece 200 once again. Consequently, the upper plane 26 directly removes the uneven top surface of the workpiece 200, and the workpiece 200 is completely planed even.

As it should be, referring to FIGS. 1 and 7, users amend the position of the adjusting base 20 via the adjusting unit 40. Herein, the hand wheel 42 is driven to rotate the worm 43, so that the worm wheel 44 is motivated to further trigger the chain 46 concurrently bringing the adjusting shafts 12. As a result, the adjusting base 20 stably displaces along the adjusting shaft 12, thence avoiding the shortcoming of a slanted adjusting base. Thus, the processing surface of the workpiece 200 is ensured not to incline.

I claim:

1. A two-sided planer comprising:

a base including a working platen; a plurality of adjusting shafts being disposed adjacent to said working platen; said base further including a lower plane pivoted on said working platen; said lower plane being served as a reference line for said working platen to be longitudinally divided into a front working area and a rear working area;

an adjusting base having adjusting holes disposed corresponding to said adjusting shafts for being penetrated by said adjusting shaft; said adjusting base being mounted above said working platen; an accommodating room being concavely disposed on one side of said adjusting base facing said working platen; a pre-pressing plate, at least one pressing shaft, an upper plane, and a progressing shaft being sequentially pivoted within said accommodating room along a longitudinal direction of said working platen; wherein, said pre-pressing plate is arranged at said front working area; said pressing shaft, said upper plane, and said progressing shaft are arranged at said rear working area; and a floated pressing unit being pivoted within said accommodating room of said adjusting base; said floated pressing unit being further situated between said pre-pressing plate and said pressing shaft and is arranged at said front working area; said floated pressing unit including an axle shaft, plural pressing rings and plural elastic propping elements; wherein, said axle shaft, pivoted to said adjusting base, radially defines a plurality of horizontal cross-sections, each of which has a plurality of receiving recesses disposed around an outer surface of said axle shaft; said pressing rings being respectively superimposed on said axle shaft with respect to said cross-sections; a certain spacing being defined between an inner surface of said pressing ring and said axle shaft; said elastic propping elements being received in said receiving recesses; one end of said elastic propping element protruding from said receiving recess to elastically prop against said inner surface of said pressing ring.

2. The two-sided planer as claimed in claim 1, wherein, a plurality of longitudinal recesses are axially disposed on said outer surface of said axle shaft at equivalent intervals; a prominent element is arranged on said inner surface of said pressing ring corresponding to said longitudinal recess.

3. The two-sided planer as claimed in claim 1, wherein, said elastic propping element includes a rod and a spring; one end of said rod protrudes out of said receiving recess for forming a head portion; said spring places over said rod and stays between said head portion and said receiving recess for elastically pushing said head portion, so that said head portion props against said inner surface of said pressing ring.

4. The two-sided planer as claimed in claim 1, wherein, a one-way gear is surrounded on said outer surface of said pressing ring.

5. The two-sided planer as claimed in claim 1, wherein, a limiting plate and a limiting ring are respectively placed over two ends of said axle shaft of said floated pressing unit for limiting said pressing ring on said axle shaft.

6. The two-sided planer as claimed in claim 1, wherein, said two-sided planer further comprises an adjusting unit including a driving shaft pivoted to said base; said driving shaft is situated adjacent to one of said adjusting shafts; one end of said driving shaft protrudes out of said base for connecting to a hand wheel; the other end of said driving shaft connects to a worm; a correspondent worm wheel being disposed on said adjusting shaft that is close to said driving shaft, so that said driving shaft permits a rotative operation of said adjusting shaft to be driven; said adjusting unit further comprises a plurality of gear units respectively disposed on a bottom of each adjusting shaft; said adjusting unit is arranged on said gear units via a chain disposed therearound, so that users are able to drive said adjusting shafts via said hand wheel.

7. The two-sided planer as claimed in claim 6, wherein, said adjusting unit further comprises an adjusting gear disposed on said base, and said adjusting gear is engaged with said chain for compressing said chain.

* * * * *